US010994295B2

(12) United States Patent
Ramsuer

(10) Patent No.: US 10,994,295 B2
(45) Date of Patent: May 4, 2021

(54) SPRAY DEVICE AND METHODS FOR MAKING THE SAME

(71) Applicant: Silgan Dispensing Systems Corporation, Grandview, MO (US)

(72) Inventor: Brandon L. Ramsuer, Henrico, VA (US)

(73) Assignee: Silgan Dispensing Systems Corporation, Grandview, MO (US)

( * ) Notice: Subject to any disclaimer, the term of this patent is extended or adjusted under 35 U.S.C. 154(b) by 0 days.

(21) Appl. No.: 16/494,292

(22) PCT Filed: Mar. 19, 2018

(86) PCT No.: PCT/US2018/023188
§ 371 (c)(1),
(2) Date: Sep. 14, 2019

(87) PCT Pub. No.: WO2018/170519
PCT Pub. Date: Sep. 20, 2018

(65) Prior Publication Data

US 2020/0130001 A1 Apr. 30, 2020

Related U.S. Application Data

(60) Provisional application No. 62/472,714, filed on Mar. 17, 2017.

(51) Int. Cl.
*B05B 11/04* (2006.01)

(52) U.S. Cl.
CPC ..... *B05B 11/043* (2013.01)

(58) Field of Classification Search
CPC ..... B05B 11/043; B05B 11/04; B05B 11/042; B05B 11/047
See application file for complete search history.

(56) References Cited

U.S. PATENT DOCUMENTS 1,811,919 A 6/1931 Dardel
2,986,310 A * 5/1961 Spaulding ..... B65D 47/248 222/481.5
3,088,680 A * 5/1963 Fulton ..... B65D 83/32 239/337
3,176,883 A * 4/1965 Davis, Jr. ..... B05B 11/043 222/633
3,432,080 A 3/1969 Venus, Jr.
4,122,979 A 10/1978 Laauwe
4,531,659 A * 7/1985 Wright ..... A45D 27/10 222/190
4,722,463 A * 2/1988 Anderson ..... B67D 3/00 137/588

(Continued)

FOREIGN PATENT DOCUMENTS

WO WO-8909095 A1 * 10/1989 ..... B05B 11/043

*Primary Examiner* — Donnell A Long
(74) *Attorney, Agent, or Firm* — Barlow, Josephs & Holmes, Ltd.

(57) ABSTRACT

A spray device includes a spray closure (100) attached to a container (900), the spray closure (100) having an air intake and a fluid intake into a mixing chamber (150) where the air and fluid are mixed before exiting an orifice (130), the air intake connected to a snorkel (120) for delivering air from within the container (900) into the mixing chamber (150).

9 Claims, 4 Drawing Sheets

(56) References Cited

U.S. PATENT DOCUMENTS

| | | | | |
|---|---|---|---|---|
| 5,037,006 | A * | 8/1991 | Kock | B05B 11/0059 222/190 |
| 5,110,011 | A | 5/1992 | Laska et al. | |
| 5,301,846 | A | 4/1994 | Schmitz | |
| 5,323,935 | A | 6/1994 | Gosselin et al. | |
| 5,398,104 | A * | 3/1995 | Arcaro | B01F 15/04 141/65 |
| 5,657,909 | A | 8/1997 | Barriac | |
| 6,276,571 | B1 * | 8/2001 | Clemmons | B67D 7/005 222/464.2 |
| 2002/0153389 | A1 * | 10/2002 | Creaghan | B05B 11/043 222/190 |
| 2012/0234870 | A1 | 9/2012 | Good et al. | |
| 2014/0091111 | A1 | 4/2014 | Dennis | |

* cited by examiner

SPRAY DEVICE AND METHODS FOR MAKING THE SAME

BACKGROUND OF THE INVENTION

Field of the Invention

Embodiments of the invention relate to spray devices and more particularly to spray devices incorporating a vent, dip tube, or snorkel to allow the intake and expulsion of air with a product.

State of the Art

Spray devices such as trigger sprayers, pumps, battery operated sprayers, and other dispensers are used with a wide-variety of consumer products. For example, hard surface cleaners, garden products, water, and other fluids are dispensed using various dispensing devices. While such devices may be used to distribute and spray or stream fluids, the costs associated with such products may not be feasible for certain applications. In addition, in lower-cost applications, closures and simple sprayers may allow for the aspiration of a spray in a vertical position, but when positioned in an inverted position, or pointing downwards, aspiration of a fluid with air is difficult or impossible to achieve. Thus, new and improved dispensing systems may be desirable.

BRIEF SUMMARY OF THE INVENTION

According to certain embodiments of the invention, a gas or air path may be incorporated with a spray device to provide a gas or air stream capable of mixing with a fluid during dispersion from a spray device or dispenser.

In some embodiments of the invention, a spray cap may be fitted with a dip tube configured to be in communication with an air or gas source during operation. In other embodiments, a spray cap may include a connection adapted to fit into a blown-in dip tube incorporated into a bottle to provide a gas or air source that can be mixed with a fluid being dispensed from the spray device.

According to certain embodiments of the invention, a snorkel or dip tube may be incorporated with a spray device to provide a gas or air path for the spray device and a container to which the spray device is attached may include an air chamber or feature to provide improved access for the snorkel or dip tube to air or gas during operation.

BRIEF DESCRIPTION OF THE DRAWINGS

While the specification concludes with claims particularly pointing out and distinctly claiming particular embodiments of the present invention, various embodiments of the invention can be more readily understood and appreciated by one of ordinary skill in the art from the following descriptions of various embodiments of the invention when read in conjunction with the accompanying drawings in which:

DETAILED DESCRIPTION OF THE INVENTION

Figure 1:
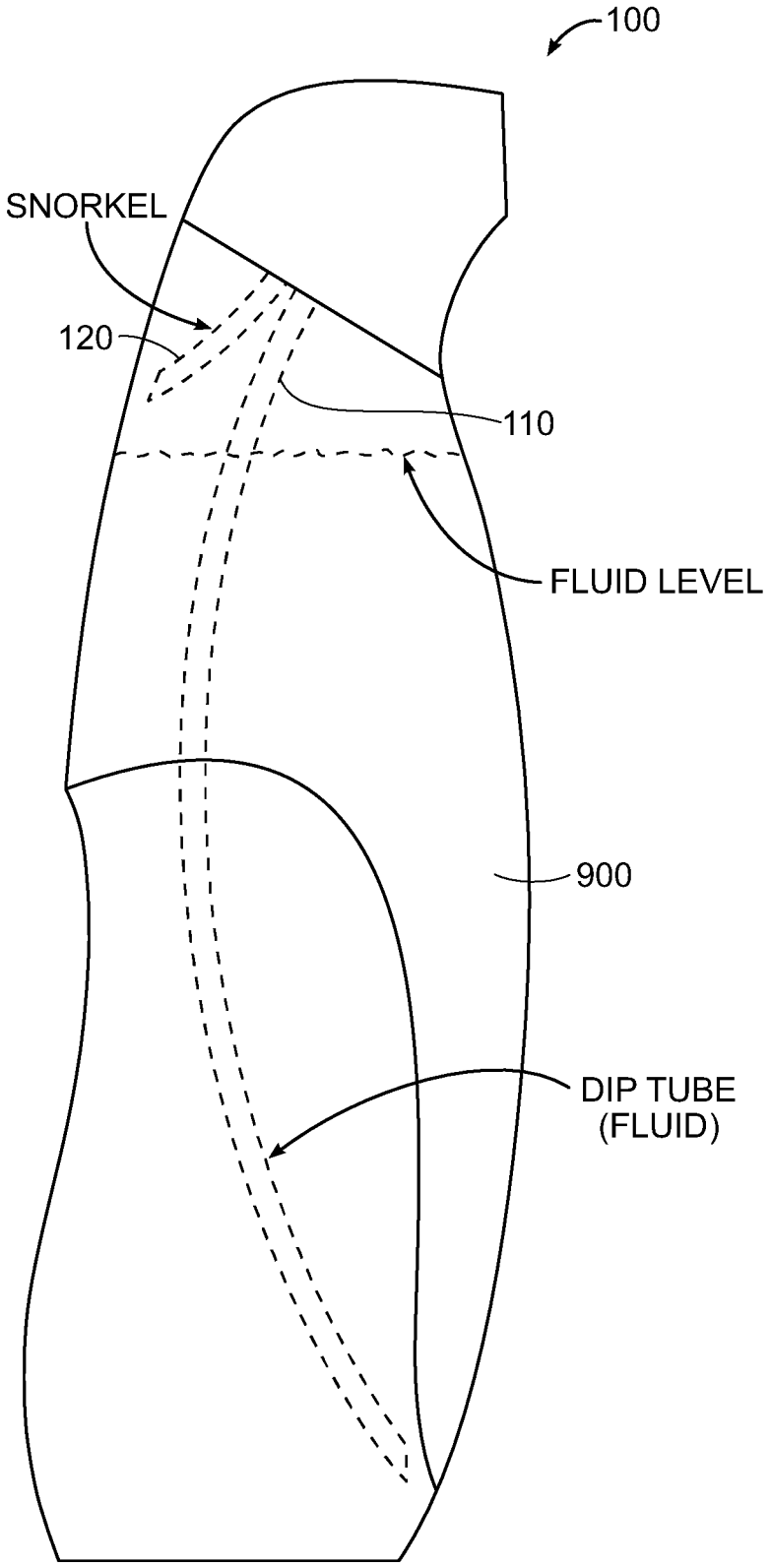
FIG. 1 illustrates a spray device according to various embodiments of the invention.

According to embodiments of the invention, a spray device includes a container 900 and a spray closure 100 attached to the bottle as illustrated in FIG. 1. A dip tube 110 may be attached to the spray closure 100. A snorkel 120—or smaller dip tube—may also be attached to the spray closure 100. The dip tube 110 may be configured to deliver a fluid product stored in the container 900 to a dispensing orifice in the spray closure 100 so that the fluid may be dispensed from the spray closure 100. The snorkel 120 may be configured to deliver air or a gas to the spray closure 100 to mix with or to agitate the fluid being dispensed from the spray closure 100.

As illustrated in FIG. 1, the snorkel 120 may be a shortened dip tube, tube, or other device having a gas flow path through which air or other gas may flow during operation of the spray device. The snorkel 120 may be integrated or formed with the dip tube 110 such that the two components may be assembled to the spray closure 100 together. In other embodiments of the invention, the snorkel 120 and dip tube 110 may be separate components that are attached to the spray closure 100 separately. In some embodiments of the invention, a snorkel 120 may be molded with and may be a part of the spray closure 100.

In operation, a user may squeeze the container 900 to force fluid through the dip tube 110 and out of the spray closure 100. As the container 900 is squeezed, air in the container—as illustrated in FIG. 1—is pushed through the snorkel 120 and the air may combine with the fluid as the fluid is dispersed from the spray device. The combination of air with the fluid may help to create a spray rather than a stream of fluid from the spray closure 100. For example, when a spray device not having a snorkel 120 and only a dip tube 110 is squeezed, the fluid is dispersed in a stream. For those applications that require a spray pattern, mist, or fine droplets rather than a stream, a snorkel 120 may be incorporated into the spray device to provide air or gas that can be mixed with the fluid and which may assist in aspirating or breaking up the fluid stream to produce a spray pattern rather than a stream.

Figure 2:
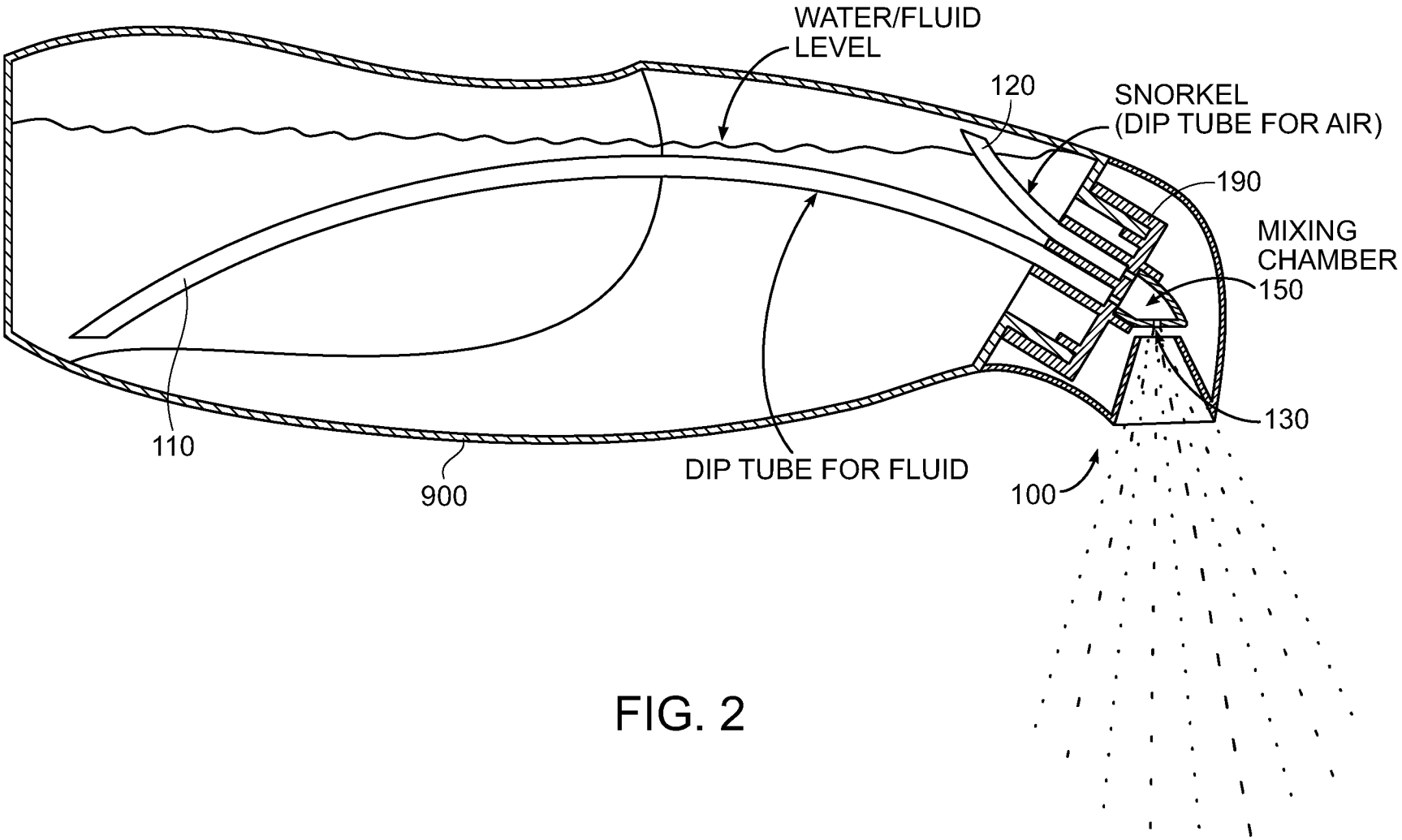
FIG. 2 illustrates a cross-sectional view of a spray device according to various embodiments of the invention.

An example of a spray device in use according to certain embodiments of the invention is illustrated in the FIG. 2. The spray device includes a container 900 having a spray closure 100 attached thereto. As illustrated, in use the spray device may be put into a horizontal position. Fluid in the container 900 may level out and the end of the snorkel 120 may sit or be positioned above the fluid and in an air or gas pocket within the container 900. As the container 900 walls are squeezed, fluid is forced through the dip tube 110 and air is forced through the snorkel 120. The fluid moves into the mixing chamber 150 along with air from the snorkel 120 where the fluid and air are mixed before being expelled through the orifice 130. In this manner, a spray rather than a stream of product is dispensed from the spray device.

According to various embodiments of the invention, a spray closure 100 may include various features 190 to attach to a container 900. Traditional threaded screw features may be used with the spray closure 100 and container 900 to attach them together. In other embodiments, a bayonet style closure system may be used. In still other embodiments, the spray closure 100 may be configured to snap onto the container 900 or a neck of the container 900 in such a way that it cannot be easily removed.

A spray closure 100 may also include other features. For example, as illustrated in FIG. 2, a spray closure 100 may include an inner seal ring capable of sealing the container 900 to the spray closure 100 so that when inverted, fluid will not leak from the device. A spray closure 100 may also include a dip tube 110 receptacle for receiving and retaining a dip tube to the spray closure 100. A snorkel 120 receptacle may also be part of the spray closure 100. The dip tube receptacle and the snorkel receptacle may be in communication with a mixing chamber 150 into which fluid and air may flow during use. The mixing chamber 150 may be in communication with an orifice 130 through which the mixed air and fluid may be dispersed from the spray device 100. In some embodiments, an orifice 130 may include spin mechanic features and geometry to further break up the fluid and entrain the fluid and air as it exits the orifice 130.

A spray closure 100 according to various embodiments of the invention includes an air intake and a fluid intake. The air intake and fluid intake may be in communication with the mixing chamber 150.

Figure 3:
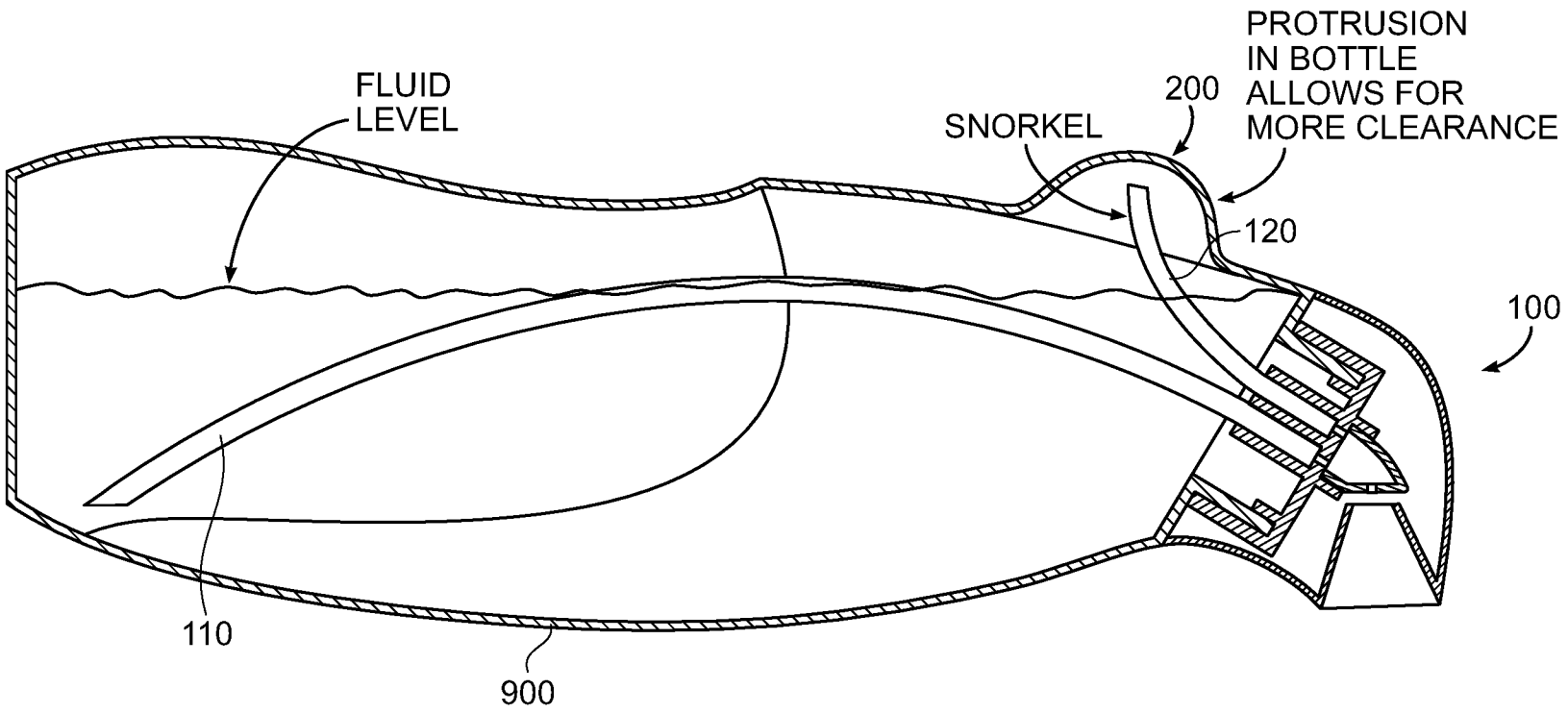
FIG. 3 illustrates a cross-sectional view of a spray device according to various embodiments of the invention.

A spray device according to other embodiments of the invention is illustrated in FIG. 3. In some embodiments of the invention, a container 900 may be configured or shaped to include an air pocket 200. As illustrated, the air pocket 200 may be located adjacent an end of a snorkel 120 or configured with the snorkel 120 configuration—to provide additional room for air to collect when a container 900 is tipped or inverted. The inclusion of the air pocket 200 may help prevent fluid entry into the snorkel 120 during use. In addition, inclusion of an air pocket 200 in the container 900 design may improve operation of the spray device when the container 900 is full of product or fluid. For example, when a container 900 is full of fluid, the amount of air in a container 900 is minimized. The inclusion of the air pocket 200 may allow for additional air to fill the air pocket 200 when tipped or inverted so that the snorkel 120 is intaking air rather than fluid.

While a certain design for an air pocket 200 is illustrated in FIG. 3, other designs and configurations may also be used. In addition, a snorkel 120 may be configured or designed to work with or sit in an air pocket 200 to improve operation of a spray device according to various embodiments of the invention.

Figure 4:
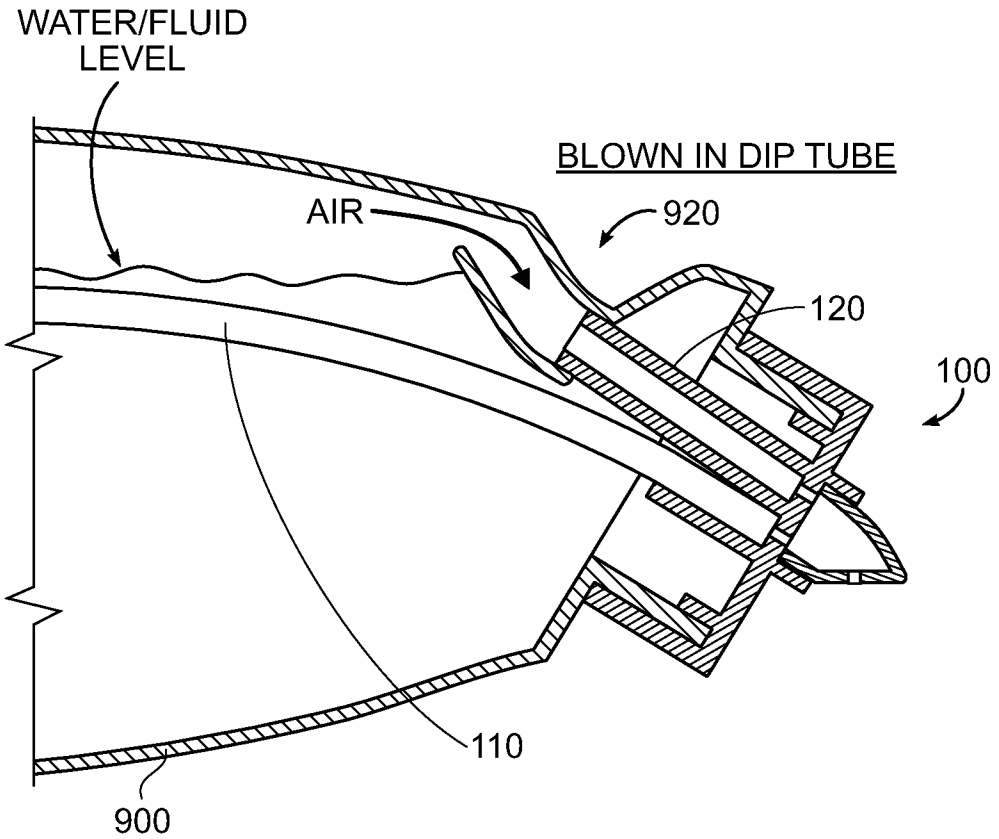
FIG. 4 illustrates a cross-sectional view of a spray device according to various embodiments of the invention.

A spray device according to still other embodiments of the invention is illustrated in FIG. 4. In some embodiments of the invention, a container 900 may include a blown-in dip tube 920 or other tube, cylinder, or opening into which a snorkel 120 may be connected. The blown-in dip tube 920 may include two openings—one into which a snorkel 120 may seat and another positioned in the container 900 at a position where air will be present when the spray device is used or is in operation.

In some embodiments, a snorkel 120 may be attached to a spray closure 100 and configured to connect the spray closure 100 to the blown-in dip tube 920. In certain embodiments, a snorkel 120 may fit into and seal with an interior diameter of a blown-in dip tube 920 as illustrated. In other embodiments, a snorkel 120 may seal against an outer diameter of a blown-in dip tube 920. In some embodiments of the invention, a snorkel 120 may be molded as part of the spray closure 100 and fitted to or sealed with a blown-in dip tube 920 as illustrated.

In use, air flows into the blown-in dip tube 920 and into the snorkel 120 where it is delivered to a mixing chamber 150 to mix with fluid and be sprayed out of an orifice 130.

While various embodiments of the invention are illustrated and described as including a dip tube 110, it is understood that in some embodiments of the invention a dip tube 110 may be omitted. In other words, a spray device may only include a snorkel 120 and not a dip tube 110. In such embodiments, when the container 900 is tipped from a non-vertical position to a horizontal or inverted position, fluid may flow into the spray closure 100 through an opening in the spray closure 100. Depending on the amount of fluid in the container 900, the spray device may need to be tipped further when there is a lesser amount of fluid in the container 900. However, for completely inverted applications, this may not be an issue and a dip tube 110 may be omitted.

In some embodiments of the invention, the spray closure 100 may also be fitted with or configured to include a valve. For example, a duck-bill valve, slit valve, ball valve, bellow, or other valve may be fitted in the spray closure 100 to prevent dispersion of fluid from the spray closure 100 until a certain pressure is applied to the container 900 to overcome the valve forces. In such embodiments, a spray device may be inverted without leaking fluid until the container 900 is squeezed or has another force applied thereto.

Having thus described certain particular embodiments of the invention, it is understood that the invention defined by the appended claims is not to be limited by particular details set forth in the above description, as many apparent variations thereof are contemplated. Rather, the invention is limited only be the appended claims, which include within their scope all equivalent devices or methods which operate according to the principles of the invention as described.

What is claimed is:

1. A spray device, comprising:

a container containing a fluid;

a spray closure attached to the container;

a dip tube attached to the spray closure and positioned on an interior of the container; and a snorkel attached to the spray closure and positioned on an interior of the container, wherein the container is configured to have a first resting position and a second dispensing position, where the second dispensing position is substantially perpendicular to the first resting position, and wherein the snorkel has a distal end that is disposed above the fluid in both the first resting position and the second dispensing position, and the snorkel does not change orientation with respect to the container in both the first resting position and the second dispensing position.

2. The spray device of claim 1, wherein the snorkel is configured to be in communication with a gas in the container when the spray device is in a horizontal position.

3. The spray device of claim 1, wherein the spray closure further comprises:

a mixing chamber; and an orifice in communication with the mixing chamber.

4. The spray device of claim 3, wherein the mixing chamber further comprises:

an air intake in communication with the mixing chamber and the snorkel; and a fluid intake in communication with the mixing chamber and the dip tube.

5. The spray device of claim 1, wherein the container further comprises an air pocket.

6. The spray device of claim 1, wherein the container further comprises a blown-in dip tube, wherein the snorkel is sealed to the blown-in dip tube and the spray closure.

7. The spray device of claim 1, wherein the snorkel is integrally formed with the spray closure.

8. The spray device of claim 1, wherein the spray closure and snorkel are a singular, molded component.

9. The spray device of claim 1, wherein the dip tube and the snorkel are curved in opposite directions relative to a vertical central axis extending through the container.

* * * * *